US011456562B2

(12) United States Patent
Oh et al.

(10) Patent No.: US 11,456,562 B2
(45) Date of Patent: Sep. 27, 2022

(54) SIGNAL TRANSMISSION CONNECTOR AND METHOD FOR MANUFACTURING SAME

(71) Applicants: Jae Suk Oh, Gyeonggi-do (KR); Kyung Sook Lim, Gyeonggi-do (KR)

(72) Inventors: Jae Suk Oh, Gyeonggi-do (KR); Kyung Sook Lim, Gyeonggi-do (KR)

( * ) Notice: Subject to any disclaimer, the term of this patent is extended or adjusted under 35 U.S.C. 154(b) by 142 days.

(21) Appl. No.: 17/260,297

(22) PCT Filed: Oct. 1, 2019

(86) PCT No.: PCT/KR2019/012781
§ 371 (c)(1),
(2) Date: Jan. 14, 2021

(87) PCT Pub. No.: WO2020/085670
PCT Pub. Date: Apr. 30, 2020

(65) Prior Publication Data

US 2021/0288446 A1 Sep. 16, 2021

(30) Foreign Application Priority Data

Oct. 26, 2018 (KR) ..... 10-2018-0128902

(51) Int. Cl.
*H01R 13/6581* (2011.01)
*H01R 13/646* (2011.01)

(52) U.S. Cl.
CPC ..... *H01R 13/6581* (2013.01); *H01R 13/646* (2013.01)

(58) Field of Classification Search
CPC ..... H01R 13/6581; H01R 13/6592; H01R 13/646
USPC ..... 439/607.41
See application file for complete search history.

(56) References Cited

FOREIGN PATENT DOCUMENTS

| | | | | |
|---|---|---|---|---|
| JP | 05-079875 | | 10/1993 | |
| JP | 2002324600 | A * | 11/2002 | ..... H01R 13/2414 |
| JP | 2004095548 | A * | 3/2004 | ..... G01R 1/06755 |
| JP | 2004096107 | A * | 3/2004 | ..... G01R 1/06755 |
| JP | 3685190 | B2 * | 8/2005 | ..... G01R 1/06755 |
| JP | 2005-327706 | | 11/2005 | |
| KR | 20-0389573 | | 7/2005 | |
| KR | 10-2005-0113281 | | 12/2005 | |
| KR | 10-1468586 | | 12/2014 | |

(Continued)

OTHER PUBLICATIONS

International Search Report dated Jan. 13, 2020 for PCT/KR2019/012781.

*Primary Examiner* — Peter G Leigh

(57) ABSTRACT

The present invention relates to a signal transmission connector connected to an electronic device, for transmitting an electrical signal, and includes a signal shielding unit in which multiple conductive particles are dispersed within an elastic insulating material in order to shield an external noise signal, a plurality of signal transmission units spaced apart within the signal shielding unit in a form in which the multiple conductive particles are arranged in a thickness direction within the elastic insulating material in such a way as to be connected to terminals of an electronic device, and a plurality of insulation units each disposed to surround the signal transmission unit between the signal transmission unit and the signal shielding unit in order to insulate the plurality of signal transmission units and the signal shielding unit.

20 Claims, 4 Drawing Sheets

(56) References Cited

FOREIGN PATENT DOCUMENTS

| | | | | | |
|---|---|---|---|---|---|
| KR | 101522624 | B1 * | 5/2015 | ..... | G01R 31/2644 |
| WO | WO-2004015760 | A1 * | 2/2004 | ..... | G01R 1/07314 |
| WO | WO-2004086565 | A1 * | 10/2004 | ..... | G01R 1/0735 |
| WO | WO-2004093254 | A1 * | 10/2004 | ..... | G01R 1/0735 |
| WO | WO-2018034500 | A1 * | 2/2018 | ..... | G01R 1/04 |

* cited by examiner

< Prior Art >

< Prior Art >

SIGNAL TRANSMISSION CONNECTOR AND METHOD FOR MANUFACTURING SAME

This application claims the priority of Korean Patent Application No. 10-2018-0128902, filed on Oct. 26, 2018 in the KIPO (Korean Intellectual Property Office), the disclosure of which is incorporated herein entirely by reference. Further, this application is the National Stage application of International Application No. PCT/KR2019/012781, filed Oct. 1, 2019, which designates the United States and was published in Korean. Each of these applications is hereby incorporated by reference in their entirety into the present application.

TECHNICAL FIELD

The present invention relates to a signal transmission connector and, more particularly, to a signal transmission connector capable of stably transmitting an electrical signal by shielding an external noise signal. The present invention also relates to a method of manufacturing the same.

BACKGROUND ART

Many electronic devices use a radio frequency (RF) signal to transmit information. The RF signal is usually transmitted through a predetermined conductive line; however, some of the signal is leaked to the outside of the conductive line, causing intereference with other nearby electrical signals.

In larger electronic devices, a special connector is frequently used to remedy this problem. The connector has a metal structure for preventing some of the leaked signal from affecting another electric circuit and for preventing outside interference from reaching the conductive line.

Recently, in the case of small wireless electronic devices such as smartphones, several different frequencies may be used in a single electronic device. As the number of frequencies used is increased, the number of condictive lines needed tends to increase, which increases size. (See, e.g., FIG. 2) Accordingly, there is a difficulty in using a conventional connector having a metal structure in small electronic devices such as smartphones.

Meanwhile, as shown in FIG. 1, there has been proposed a technology for transmitting an RF signal using silicon rubber as an insulation unit 10 and using conductive metal powder as a conductive unit 20. Such a connector blocks a noise signal by forming a signal shielding unit 30 surrounding the periphery of the conductive unit 20 using conductive metal powder.

However, such a conventional connector has low shielding efficiency compared to a connector using a conventional metal structure because fine conductive metal powder is mixed with silicon to form the shape of the signal shielding unit and thus many gaps are present in the signal shielding unit 30.

Additional issues are created with conventional connectors. For example, as shown in FIG. 2, in a conventional connector having a plurality of conductive units 20, an interval "A" is determined based on a corresponding frequency because impedance (AC impedance) needs to be matched based on an RF frequency region. Accordingly, if the interval between the conductive units 20 is 0.8 mm or less, it results in a structure in which the signal shielding units 30 are overlapped.

Such a conventional connector is fabricated in such a manner that a mixture in which conductive metal powder and liquefied silicon rubber have been mixed is injected into a die in which the same magnetic poles as shapes of the conductive unit 20 and the signal shielding unit 30 have been provided on the upper and lower side and a magnetic field is applied to the die. When the magnetic field is applied to the die, the conductive metal powder mixed in the liquefied silicon gathers at the magnetic pole. By solidifying the liquefied silicon in this state, the connector having the conductive unit 20 and the signal shielding unit 30 can be fabricated.

However, in such a conventional connector, upon fabrication, more conductive metal powder gathers at area "C" than at area "B". The density of the conductive metal powder is thus lower in the area "B" than in surrounding areas. Where less conductive metal powder gathers, shielding performance for a noise signal received from the outside is reduced.

While adding additional metal powder may help solve this problem, another problem is created in that the conductive unit 20 and the signal shielding unit 30 may become electrically connected.

DISCLOSURE OF THE INVENTION

Technical Problem

Accordingly, the present invention has been made to solve the above problems. The present invention provides a signal transmission connector capable of improving shielding performance from outside noise by extending the distribution area of conductive particles in a signal shielding unit. The present invention also provides a method of manufacturing such as signal transmission connector.

Technical Solution

A signal transmission connector according to the present invention comprises a signal shielding unit in which multiple conductive particles are dispersed within an elastic insulating material in order to shield an external noise signal; a plurality of signal transmission units spaced apart from each other within the signal shielding unit in a form in which the multiple conductive particles are arranged in a thickness direction within the elastic insulating materials so that the signal transmission units are connected to terminals of the electronic device; and a plurality of insulation units each disposed to surround one of the signal transmission units between the signal transmission unit and the signal shielding unit in order to insulate the plurality of signal transmission units and the signal shielding unit. The signal shielding unit surrounds the signal transmission unit by a triple shielding structure, including a block shielding unit in which the plurality of signal transmission units and the plurality of insulation units are disposed and the multiple conductive particles are dispersed within the elastic insulating material, the block shielding unit having lower density of the conductive particles than the signal transmission unit, a plurality of internal high-density shielding units each disposed to surround the insulation unit between the block shielding unit and the insulation unit, the internal high-density shielding unit having higher density of the conductive particles than the block shielding unit, and an external high-density shielding unit positioned to surround the edges of the block shielding unit and having higher density of the conductive particles than the block shielding unit.

The insulation unit may be made of an elastic insulating material, and the elastic insulating material of the insulation unit may be solidified in an integrated form along with the elastic insulating material of the signal shielding unit and the elastic insulating material of the signal transmission unit.

Ends on both sides of the signal transmission unit may be protruded from surfaces on both sides of the signal shielding unit.

The signal transmission connector may be connected to an electronic device and may be used for transmitting an electrical signal. In one embodiment, such a signal transmission connector comprises a plurality of signal transmission units in which multiple conductive particles are arranged in a thickness direction within an elastic insulating material so that the signal transmission units are connected to terminals of the electronic device; an insulation unit to insulate the plurality of signal transmission units by surrounding the surroundings of the plurality of signal transmission units; and a signal shielding unit configured in a form in which multiple conductive particles are dispersed within the elastic insulating material in order to shield an external noise signal, positioned adjacent to the plurality of signal transmission units between the plurality of signal transmission units, and positioned in the middle of the insulation unit so that the signal shielding unit is spaced apart from the plurality of signal transmission units with a gap between the signal shielding unit and each of the plurality of signal transmission units. The signal shielding unit has a triple shielding structure, including a block shielding unit in which the multiple conductive particles are dispersed within the elastic insulating material, the block shielding unit having lower density of the conductive particles than the signal transmission unit, a plurality of internal high-density shielding units each positioned within the block shielding unit, the internal high-density shielding unit having higher density of the conductive particles than the block shielding unit, and an external high-density shielding unit positioned to surround the edges of the block shielding unit, the external high-density shielding unit having higher density of the conductive particles than the block shielding unit.

The insulation unit may be made of an elastic insulating material, and the elastic insulating material of the insulation unit may be solidified in an integrated form along with the elastic insulating material of the signal shielding unit and the elastic insulating material of the signal transmission unit.

The end of the internal high-density shielding unit may be protruded from a surface of the block shielding unit.

Additionally, a method of manufacturing a signal transmission connector according to the present invention is provided which includes the steps of (a) preparing an upper die, including an upper die plate, a first upper magnetic body positioned on the inside of the upper die plate and provided with a plurality of upper magnetic body holes, a plurality of second upper magnetic bodies disposed on the inside of the upper die plate in such a way as to be disposed within the plurality of upper magnetic body holes, respectively, and a plurality of upper non-magnetic bodies disposed on the inside of the upper die plate in such a way as to surround the circumference of the second upper magnetic body between the plurality of first upper magnetic bodies and the second upper magnetic body; and a lower die, including a lower die plate, a first lower magnetic body positioned on an inside of the lower die plate and provided with a plurality of lower magnetic body holes in the middle of the first lower magnetic body, a plurality of second lower magnetic bodies disposed on the inside of the lower die plate in such a way as to be disposed within the plurality of lower magnetic body holes, respectively, and a plurality of lower non-magnetic bodies disposed on the inside of the upper die plate in such a way as to surround a circumference of the second lower magnetic body between the first lower magnetic body and the second lower magnetic body; (b) injecting a molding material, containing conductive particles within a liquefied elastic insulating material, into a cavity provided between the upper die and the lower die; (c) forming a plurality of signal transmission units by vertically applying a magnetic field to the molding material injected into the cavity through the plurality of second upper magnetic bodies and the plurality of second lower magnetic bodies so that some of the conductive particles of the molding material are concentrated between the second upper magnetic body and the second lower magnetic body, forming a signal shielding unit to surround the surroundings of the plurality of signal transmission units by vertically applying a magnetic field to the molding material injected into the cavity through the plurality of first upper magnetic bodies and the first lower magnetic body so that some of the conductive particles of the molding material are dispersed into the surroundings of the plurality of signal transmission units, and concentrating the conductive particles of the molding material on the signal transmission unit and the signal shielding unit so that an electrical connection by the conductive particles of the molding material is not performed between the signal transmission unit and the signal shielding unit; (d) forming a signal transmission connector by solidifying the molding material; and (e) separating the signal transmission connector from the upper die and the lower die. In the step (c), the signal shielding unit is configured in a form to surround the signal transmission unit by a triple shielding structure, including a block shielding unit in which the plurality of signal transmission units and the plurality of insulation units are disposed and the multiple conductive particles are dispersed within the elastic insulating material, the block shielding unit having lower density of the conductive particles than the signal transmission unit, a plurality of internal high-density shielding units each disposed to surround the insulation unit between the block shielding unit and the insulation unit, the internal high-density shielding unit having higher density of the conductive particles than the block shielding unit, and an external high-density shielding unit positioned to surround the edges of the block shielding unit and having higher density of the conductive particles than the block shielding unit, by inducting a strong magnetic field compared to other portions of the plurality of first upper magnetic bodies into a circumference and external edge portion of the upper magnetic body hole among the plurality of first upper magnetic bodies, and inducing a strong magnetic field compared to other portions of the first lower magnetic body into the circumference and external edge portion of the lower magnetic body hole among the first lower magnetic body.

Advantageous Effects

The signal transmission connector according to the present invention has excellent noise signal shielding performance compared to conventional technology because the signal shielding unit whose distribution area of conductive particles has been extended is positioned near the signal transmission unit for transmitting a signal.

Furthermore, the signal transmission connector according to the present invention can more effectively shield a noise signal compared to a conventional technology because the signal shielding unit surrounding the surroundings of the signal transmission unit has a triple shielding structure, including the internal high-density shielding unit in which conductive particles are concentrated and the density of the conductive particles are relatively high, the block shielding unit in which conductive particles are distributed to a wide area, and the external high-density shielding unit in which conductive particles are concentrated and the density of the conductive particles are relatively high.

BEST MODE FOR CARRYING OUT THE INVENTION

Hereinafter, a signal transmission connector and method of manufacturing the same according to the present invention are described in detail with reference to the drawings.

Figure 3:
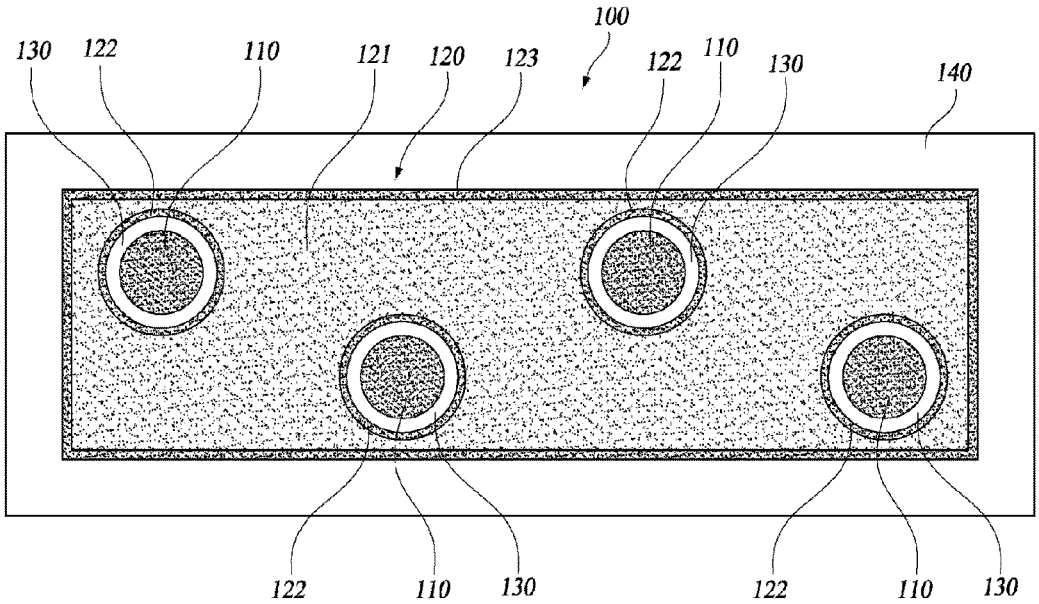
FIG. 3 is a plan view showing a signal transmission connector according to an embodiment of the present invention.
Figure 4:
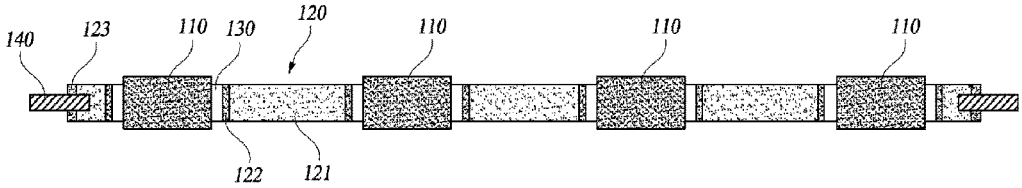
FIG. 4 is a cross-sectional view showing a signal transmission connector according to an embodiment of the present invention.

FIG. 3 is a plan view showing a signal transmission connector according to an embodiment of the present invention. FIG. 4 is a cross-sectional view showing a signal transmission connector according to an embodiment of the present invention.

As shown in the drawings, the signal transmission connector 100 according to an embodiment of the present invention is connected to an electronic device and is designed to transmit an electrical signal. The signal transmission connector 100 includes a plurality of signal transmission units 110 capable of being connected to the terminals of an electronic device, a signal shielding unit 120 surrounding the surroundings of the plurality of signal transmission units 110, a plurality of insulation units 130 disposed between the signal transmission unit 110 and the signal shielding unit 120, and a support plate 140 coupled to the signal shielding unit 120 to support the signal shielding unit 120. The signal transmission connector 100 can stably transmit a signal and improve signal transmission efficiency because the signal shielding unit 120 surrounding the surroundings of the signal transmission unit 110 prevents external noise signals from reaching the signal transmission unit 110.

The signal transmission unit 110 has a form in which multiple conductive particles 154 have been arranged in a thickness direction within an elastic insulating material 152 so that the signal transmission unit 110 is connected to a terminal of an electronic device. The plurality of signal transmission units 110 are spaced apart within the signal shielding unit 120 so that they correspond to terminals provided in an electronic device, that is, a target of connection. As shown, the signal transmission unit 110 may have a cylindrical shape, and ends on both sides thereof may be protruded from a surface of the signal shielding unit 120 so that the signal transmission unit 110 is stably connected to a terminal of an electronic device.

A theromstable polymer material having a bridge structure, for example, silicon rubber, polybutadiene rubber, natural rubber, polyisoprene rubber, styrene-butadiene copolymer rubber, acrylonitrile-butadiene copolymer rubber, styrene-butadiene-dien block copolymer rubber, styrene-isoprene block copolymer rubber, urethane rubber, polyester rubber, epicrolhydrin rubber, ethylene-propylene copolymer rubber, ethylene-propylene-dien copolymer rubber, or soft liquefied epoxy rubber may be used as the elastic insulating material 152 that forms the signal transmission unit 110.

Furthermore, a material having magnetism may be used as the conductive particles 154 configuring an electronic device so that the material can respond to a magnetic field. For example, a material including metal particles having magnetism, such as iron, nickel, or cobalt or alloy particles thereof or particles containing metal thereof or particles thereof as core particles and having metal having excellent conductivity, such as gold, silver, palladium or radium, coated on a surface of the core particles, or a material including non-magnetic metal particles, inorganic substance particles such as glass beads, or polymer particles as core particles and having a conductive magnetic body, such as nickel or cobalt, coated on a surface of the core particles, or a material having a conductive magnetic body and metal having excellent conductivity coated on the core particles may be used as the conductive particles 154.

The signal shielding unit 120 has a form in which the multiple conductive particles 154 have been dispersed within the elastic insulating material 152 in order to shield an external noise signal. The signal shielding unit 120 is positioned to surround the surroundings of the signal transmission unit 110. When the signal transmission unit 110 is connected to a terminal of an electronic device, the signal shielding unit 120 is grounded, thus being capable of shielding an external noise signal so that it does not reach the signal transmission unit 110.

The same conductive particles 154 comprising the signal transmission unit 110 may be used as the conductive particles 154 for the signal shielding unit 120. Furthermore, the same elastic insulating material 152 comprising the signal transmission unit 110 may be used as the elastic insulating material 152 for the signal shielding unit 120. The elastic insulating material 152 of the signal shielding unit 120 may be solidified in an integrated form along with the elastic insulating material 152 of the signal transmission unit 110. That is, upon fabrication of the signal transmission connector 100, the elastic insulating material 152 of the signal shielding unit 120 and the elastic insulating material 152 of the signal transmission unit 110 may be solidified together in an integrated form.

The signal shielding unit 120 includes a block shielding unit 121 in which a plurality of the signal transmission units 110 and a plurality of the insulation units 130 are disposed, a plurality of internal high-density shielding units 122 disposed between the block shielding unit 121 and the plurality of insulation units 130, and an external high-density shielding unit 123 positioned to surround the edges of the block shielding unit 121.

The block shielding unit 121 has a form in which the multiple conductive particles 154 are generally uniformly dispersed within the elastic insulating material 152. In the drawings, the block shielding unit 121 has been illustrated as having a rectangular plate or rectangular block shape having a given thickness, but the block shielding unit 121 is not limited to that illustrated in the drawing. The block shielding unit 121 may be changed in various other forms to surround the surroundings of the plurality of signal transmission units 110 and the plurality of insulation units 130.

The internal high-density shielding unit 122 has a form in which the multiple conductive particles 154 are concentrated within the elastic insulating material 152 to surround the circumference of the insulation unit 130. The density of conductive particles of the internal high-density shielding unit 122 is higher than the density of conductive particles of the block shielding unit 121. Noise signal shielding performance can be further improved because the internal high-density shielding unit 122 having relatively higher density of conductive particles as described above surrounds the circumference of the signal transmission unit 110. In the drawings, the internal high-density shielding unit 122 has a cylindrical shape to surround the edge of the insulation unit 130, but the internal high-density shielding unit 122 may be changed in various other forms capable of surrounding the insulation unit 130.

The external high-density shielding unit 123 has a form in which the multiple conductive particles 154 are concentrated within the elastic insulating material 152 to surround the edges of the block shielding unit 121. The density of conductive particles of the external high-density shielding unit 123 is higher than the density of conductive particles of the block shielding unit 121. Noise signal shielding performance can be further improved because the external high-density shielding unit 123 having relatively higher density of the conductive particles as described above surrounds the edges of the block shielding unit 121. The external high-density shielding unit 123 is not limited to the illustrated form, but may be changed in various other forms depending on a shape of the block shielding unit 121.

Figure 1:
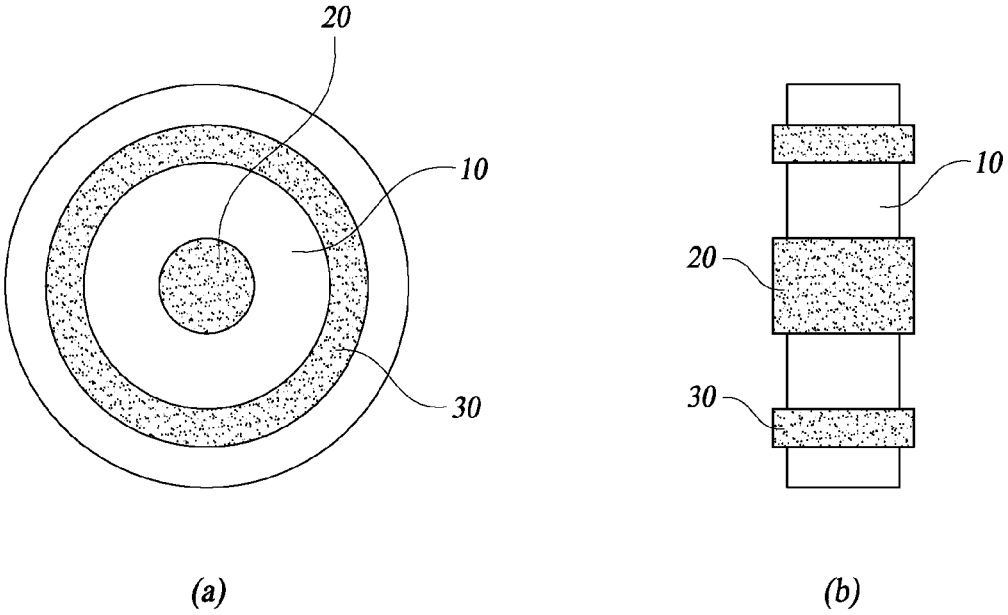
FIGS. 1 and 2 show a conventional connector.
Figure 2:
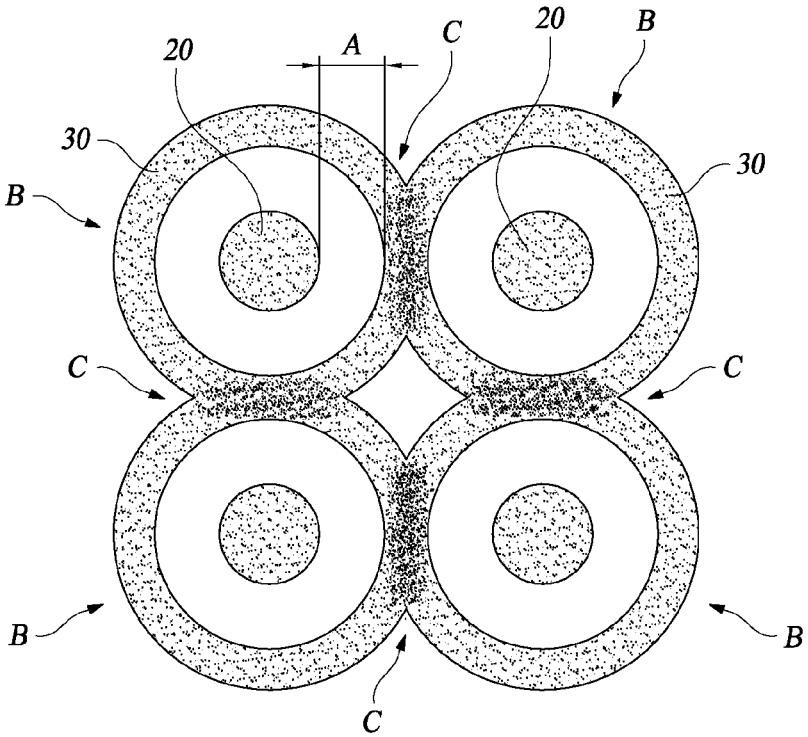

As described above, the signal shielding unit 120 has excellent noise signal shielding performance compared to a conventional technology because the signal shielding unit 120 has a structure in which the distribution area of the conductive particles 154 is further extended compared to the conventional signal shielding unit 120 shown in FIG. 1 or 2. Furthermore, the signal shielding unit 120 can more effectively shield a noise signal compared to a conventional technology because the signal shielding unit 120 surrounds the surroundings of the signal transmission unit 110 in the form of the triple shielding structure, the triple shielding structure comprising the internal high-density shielding unit 122, the block shielding unit 121, and the external high-density shielding unit 123.

Each of a plurality of the insulation units 130 is disposed to surround each signal transmission unit 110 within the block shielding unit 121 in order to insulate the plurality of signal transmission units 110 from the signal shielding unit 120. The signal transmission unit 110 and the signal shielding unit 120 are insulated by the insulation unit 130 interposed therebetween. The insulation unit 130 is made of the elastic insulating material 152.

The elastic insulating material 152 of the insulation unit 130 may be solidified in an integrated form along with the elastic insulating material 152 of the signal shielding unit 120 and the elastic insulating material 152 of the signal transmission unit 110. That is, upon fabrication of the signal transmission connector 100, the elastic insulating material 152 of the insulation unit 130 may be solidified in an integrated form along with the elastic insulating material 152 of the signal shielding unit 120 and the elastic insulating material 152 of the signal transmission unit 110. The conductive particles 154 are not present within the elastic insulating material 152 of the insulation unit 130 or a very small amount of the conductive particles 154 are present within the elastic insulating material 152 of the insulation unit 130 to the extent that an electrical signal cannot be transmitted.

The support plate 140 may be made of various materials which are not easily deformed, while stably supporting the signal shielding unit 120 having an elastic force, and which have stiffness to the extent that a shape thereof can be stably maintained. For example, the support plate 140 may be made of a material, such as a metal material, a ceramic material, or a resin material. If the support plate 140 is made of metal, the support plate 140 may include an insulating film that covers a surface of the support plate.

As described above, the signal transmission connector 100 according to an embodiment of the present invention has excellent noise signal shielding performance compared to a conventional technology because the signal shielding unit 120 having an extended distribution area of the conductive particles 154 surrounds the surroundings of the signal transmission unit 110 for transmitting a signal.

Furthermore, the signal transmission connector 100 according to an embodiment of the present invention can more effectively shield a noise signal compared to a conventional technology because the signal shielding unit 120 surrounding the surroundings of the signal transmission unit 110 has the triple shielding structure, including the internal high-density shielding unit 122 in which conductive particles are concentrated to have relatively high density of the conductive particles, the block shielding unit 121 in which conductive particles are uniformly dispersed over a wide area, and the external high-density shielding unit 123 in which conductive particles are concentrated to have relatively high density of the conductive particles.

A method of manufacturing a signal transmission connector according to an embodiment of the present invention, such as those described with reference to FIGS. 3 and 4, is described below.

Figure 5:
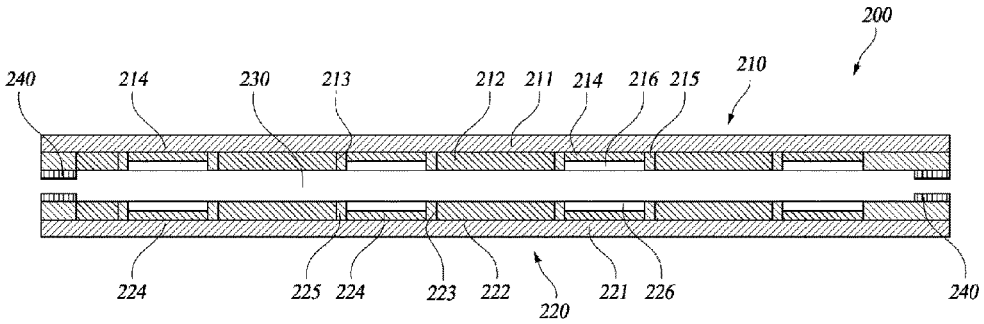
FIGS. 5 to 7 schematically show a process of manufacturing the signal transmission connector according to an embodiment of the present invention.

First, as shown in FIG. 5, a molding die 200 is prepared. The molding die 200 includes an upper die 210 and a lower die 220. A cavity 230, that is, a space where the signal transmission connector 100 will be formed, is provided between the upper die 210 and the lower die 220.

The upper die 210 includes an upper die plate 211, a first upper magnetic body 212 positioned on the inside of the upper die plate 211, a plurality of second upper magnetic bodies 214 disposed on the inside of the upper die plate 211, and a plurality of upper non-magnetic bodies 215 disposed on the inside of the upper die plate 211. The upper die plate 211 may be made of ferromagnetic metal, such as iron, an iron-nickel alloy, an iron-cobalt alloy, nickel, or cobalt.

The first upper magnetic body 212 has a shape corresponding to the signal shielding unit 120 to be fabricated. Between the first upper magnetic bodies 212, an upper magnetic body hole 213 is formed in the first upper magnetic body 212 corresponding to each of the signal transmission units 110 provided in the signal transmission connector 100 to be fabricated. The first upper magnetic body 212 may be made of ferromagnetic metal, such as iron, an iron-nickel alloy, an iron-cobalt alloy, nickel, or cobalt.

The plurality of second upper magnetic bodies 214 are disposed within the upper magnetic body holes 213, respectively, and are disposed corresponding to the plurality of signal transmission units 110 provided in the signal transmission connector 100 to be fabricated. The second upper magnetic body 214 may be made of the same ferromagnetic metal, such as iron, an iron-nickel alloy, an iron-cobalt alloy, nickel, or cobalt, as the first upper magnetic body 212.

The plurality of upper non-magnetic bodies 215 are arranged within the plurality of upper magnetic body holes 213, and are located between each first upper magnetic body 212 and an adjacent second upper magnetic body 214. The upper non-magnetic body 215 may be shaped to cover the entirety of the end of first upper magnetic body 212 and may be made of non-magnetic metal, such as copper, or a polymer material having a heat-resistance property.

The second upper magnetic body 214 has a smaller thickness than the upper non-magnetic body 215. Accordingly, an upper groove part 216 is provided corresponding to the length of the second upper magnetic body 214, and within the two adjacent upper non-magnetic bodies 215. The top of the signal transmission unit 110 of the signal transmission connector 100 to be fabricated may have a form protruded from the top surface of the signal shielding unit 120 because the upper groove part 216 is positioned within the upper non-magnetic body 215 as described above.

The lower die 220 and the upper die 210 have a symmetrical structure. That is, the lower die 220 includes a lower die plate 221, a first lower magnetic body 222 positioned on the inside of the lower die plate 221, a plurality of second lower magnetic bodies 224 disposed on the inside of the lower die plate 221, and a plurality of lower non-magnetic bodies 225 disposed on the inside of the lower die plate 221. The lower die plate 221 may be made of the same ferromagnetic metal as the upper die plate 211.

The first lower magnetic body 222 has a shape corresponding to that of the first upper magnetic body 212. A plurality of lower magnetic body holes 223 are disposed in the middle of the first lower magnetic body 222 in a form corresponding to the upper magnetic body holes 213 of the first upper magnetic body 212. The first lower magnetic body 222 may be made of the same ferromagnetic metal as the first upper magnetic body 212.

The plurality of second lower magnetic bodies 224 are disposed within the plurality of lower magnetic body holes 223, respectively, and are arranged to correspond to the plurality of second upper magnetic bodies 214. The second lower magnetic body 224 may be made of the same ferromagnetic metal as the second upper magnetic body 214.

The plurality of lower non-magnetic bodies 225 are arranged within the plurality of lower magnetic body holes 223, and are located to correspond to the plurality of upper non-magnetic bodies 215. The lower non-magnetic body 225 is interposed between the first lower magnetic body 222 and a second lower magnetic body 224 to surround the circumference of the second lower magnetic body 224. The lower non-magnetic body 225 may be made of the same material as the upper non-magnetic body 215.

The second lower magnetic body 224 has a smaller thickness than the lower non-magnetic body 225. Accordingly, a lower groove part 226 is provided in a form corresponding to the length of the second lower magnetic body 224, and within the two adjacent lower non-magnetic bodies 225. The bottom of the signal transmission unit 110 of the signal transmission connector 100 to be fabricated may have a form protruded from the bottom of the signal shielding unit 120 because the lower groove part 226 is provided within the lower non-magnetic body 225 as described above.

Figure 6:
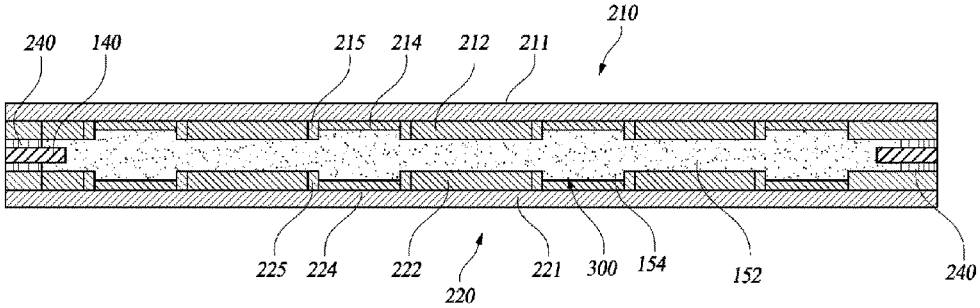
Figure 7:
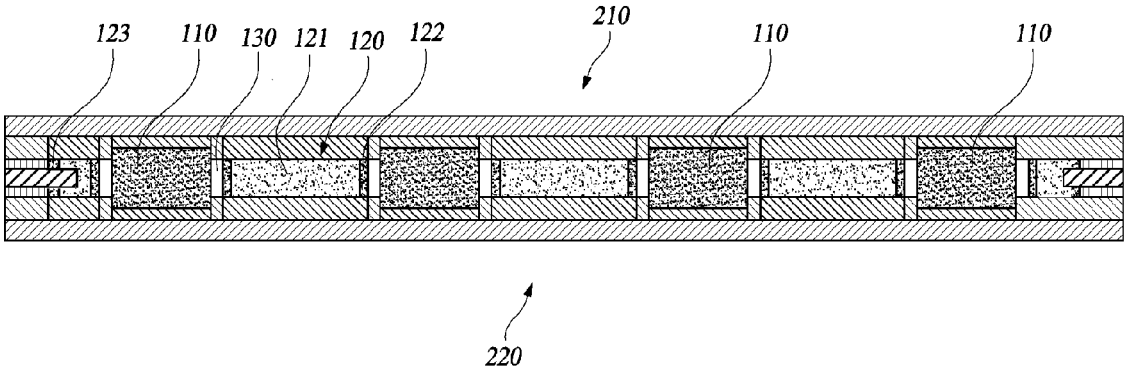

Next, as shown in FIG. 6, the support plate 140 is positioned between the upper die 210 and the lower die 220. In this case, a spacer 240 may be positioned between the upper die 210 and the support plate 140 and the spacer 240 is also positioned between the lower die 220 and the support plate 140 so that the support plate 140 is positioned at the center between the upper die 210 and the lower die 220. Furthermore, a molding material 300 containing the conductive particles 154 within the liquefied elastic insulating material 152 is injected into the cavity 230 of the molding die 200.

After the cavity 230 is filled with the molding material 300, a magnetic field is applied to the molding material 300. For example, electromagnets may be positioned at the top of the upper die plate 211 and the bottom of the lower die plate 221, and a vertical magnetic field may be applied to the molding material 300 filled into the cavity 230 by driving the electromagnets. In this case, a strong magnetic field is formed between the first upper magnetic body 212 and the first lower magnetic body 222 and between the second upper magnetic body 214 and the second lower magnetic body 224, the magnetic field being stronger in these areas than in other areas. Due to the magnetic field, the conductive particles 154 in the liquefied elastic insulating material 152 are concentrated between the first upper magnetic body 212 and the first lower magnetic body 222 and between the second upper magnetic body 214 and the second lower magnetic body 224.

As described above, the magnetic field is vertically applied to the molding material 300 through the plurality of second upper magnetic bodies 214 and the plurality of second lower magnetic bodies 224. Accordingly, the plurality of signal transmission units 110 can be formed because some of the conductive particles 154 of the molding material 300 are concentrated between each of the plurality of second upper magnetic bodies 214 and each of the plurality of second lower magnetic bodies 224.

Furthermore, a magnetic field is vertically applied to the molding material 300, injected into the cavity 230, through the first upper magnetic body 212 and the first lower magnetic body 222. Accordingly, one or more signal shielding units 120 are formed between the plurality of signal transmission units 110 because some of the conductive particles 154 of the molding material 300 are disposed between the plurality of signal transmission units 110.

In this case, a relatively weak magnetic field is formed in an area other than the areas between the first upper magnetic body 212 and the first lower magnetic body 222 and between the second upper magnetic body 214 and the second lower magnetic body 224. Accordingly, in the corresponding area, only a very small amount of the conductive particles 154 are present to the extent that an electrical signal cannot be transmitted. This corresponding area having few or no conductive particles 154 becomes the insulation unit 130 that insulates the signal transmission unit 110 and the signal shielding unit 120.

In the process of concentrating the conductive particles 154 by applying a vertical magnetic field to the first upper magnetic body 212 and the first lower magnetic body 222, stronger magnetic fields are formed at the inside edge of the first upper magnetic body 212 and the outside edge of the first lower magnetic body 222 compared to other portions. In this case, the inside edges of the first upper magnetic body 212 and the first lower magnetic body 222 correspond to the circumference of the upper magnetic body hole 213 and the circumference of the lower magnetic body hole 223. Furthermore, the outside edges of the first upper magnetic body 212 and the first lower magnetic body 222 correspond to the edges of the first upper magnetic body 212 and the first lower magnetic body 222.

Accordingly, the signal shielding unit 120 formed by the gathering of the conductive particles 154 may be divided into the internal high-density shielding unit 122 configured in a form corresponding to the circumference of the upper magnetic body hole 213 and the circumference of the lower magnetic body hole 223 and having relatively high density of conductive particles, the external high-density shielding unit 123 configured in a form corresponding to the edges of the first upper magnetic body 212 and the first lower magnetic body 222 and having relatively high density of conductive particles, and block shielding units 121, the block shielding units 121 formed, between the internal high-density shielding units 122 and the external high-density shielding unit 123.

Next, the signal transmission connector 100, including the plurality of signal transmission units 110, the signal shielding unit 120 to surround the surroundings of the signal transmission unit 110, and the plurality of insulation units 130 interposed between the plurality of signal transmission units 110 and the signal shielding unit 120, may be formed by solidifying the molding material 300. The molding material 300 may be solidified through heating processing.

Next, the signal transmission connector 100 may be obtained by separating the signal transmission connector 100 from the upper die 210 and the lower die 220.

Figure 8:
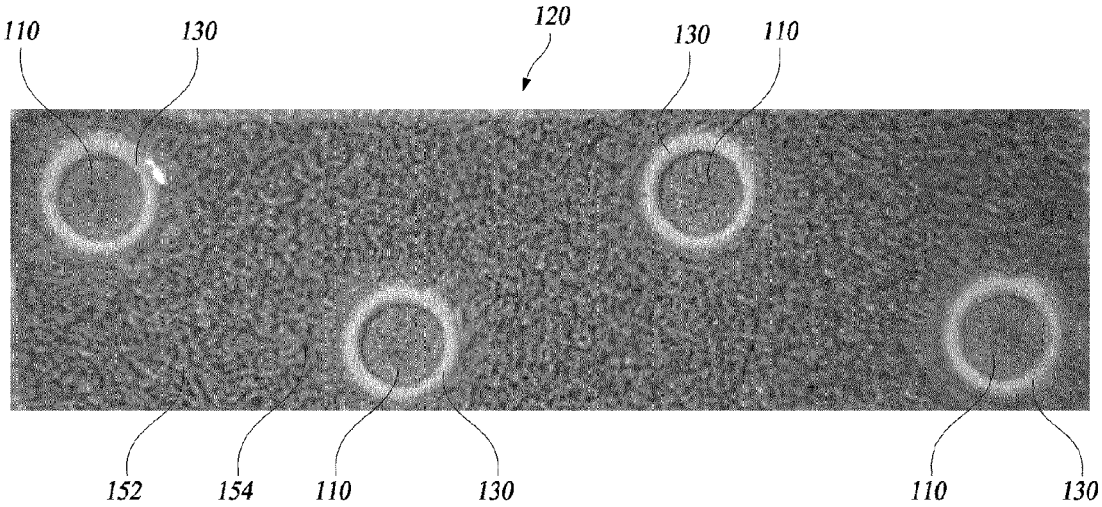
FIG. 8 is a photo showing an actual shape of the signal transmission connector according to an embodiment of the present invention.

FIG. 8 is a photo showing actual shape of the signal transmission connector fabricated using a fabrication method, such as that described above.

From the photo of FIG. 8, it can be seen that the plurality of signal shielding units 120 in which the multiple conductive particles 154 are concentrated within the elastic insulating material 152 are disposed and the insulation units 130 made of the elastic insulating material 152 are formed between the plurality of signal transmission units 110 and the signal shielding unit 120.

Figure 9:
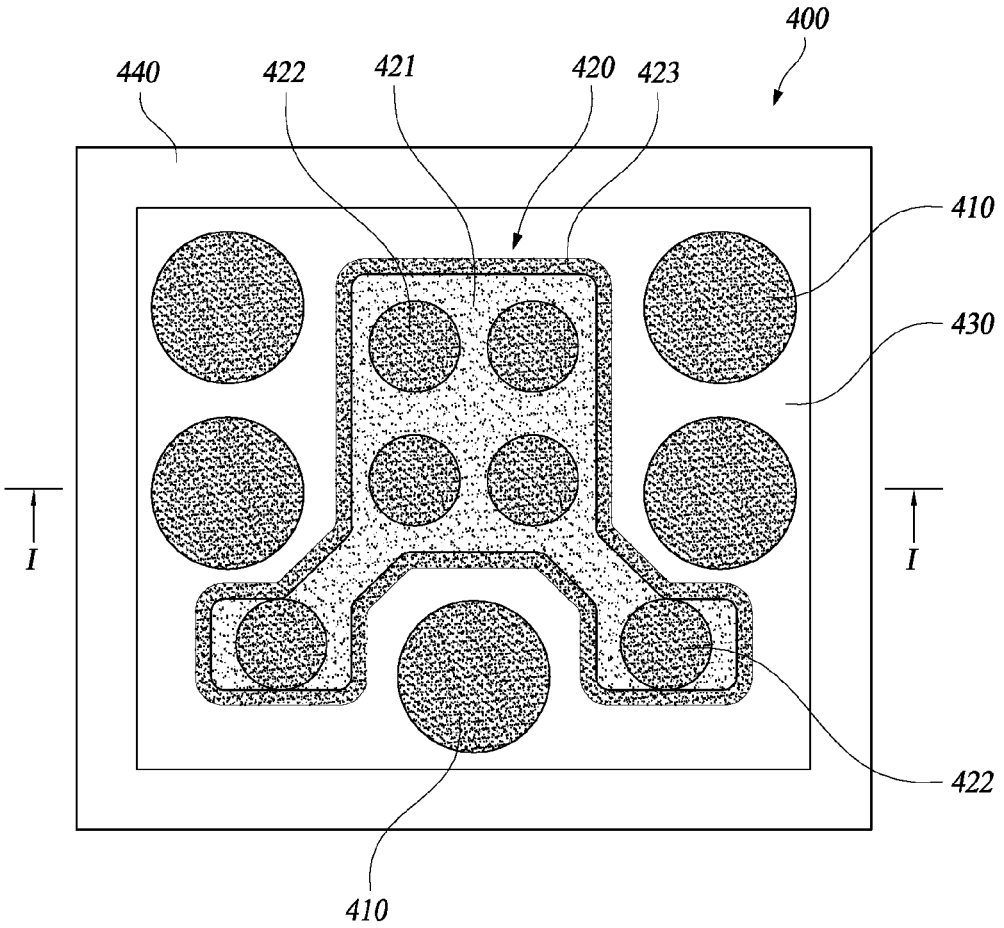
FIG. 9 is a plan view showing a signal transmission connector according to another embodiment of the present invention.
Figure 10:
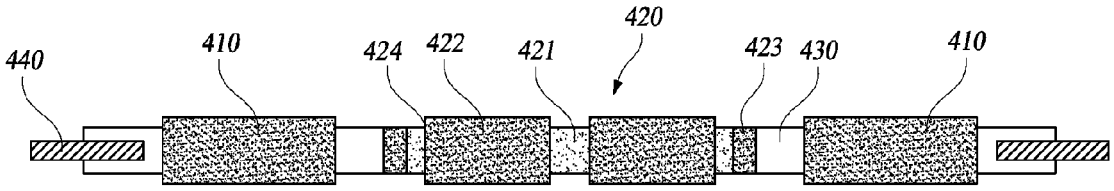
FIG. 10 is a cross-sectional view taken along line I-I of the signal transmission connector shown in FIG. 9.

Meanwhile, FIG. 9 is a plan view showing a signal transmission connector according to another embodiment of the present invention. FIG. 10 is a cross-sectional view taken along line I-I of the signal transmission connector shown in FIG. 9.

A signal transmission connector 400 shown in FIGS. 9 and 10 according to another embodiment of the present invention includes a plurality of signal transmission units 410 capable of being connected to terminals of an electronic device, a signal shielding unit 420 positioned adjacent to the plurality of signal transmission units 410, an insulation unit 430 connecting the plurality of signal transmission units 410 and the signal shielding unit 420, and a support plate 440 coupled to the insulation unit 430 to support the insulation unit 430. The signal transmission connector 400 can shield a noise signal so that the noise signal does not reach the signal transmission unit 410 by the signal shielding unit 420 positioned adjacent to the signal transmission units 410 for transmitting an electrical signal.

The signal transmission unit 410 has a form in which the multiple conductive particles 154 (refer to FIG. 6) are disposed in a thickness direction within the elastic insulating material 152 (refer to FIG. 6) so that the signal transmission unit 410 is connected to a terminal of an electronic device. As shown, the signal transmission unit 410 may have a cylindrical shape, and may have an end protruded from a surface of the insulation unit 430 so that the end can be stably connected to a terminal of an electronic device.

The signal shielding unit 420 has a form in which the multiple conductive particles 154 are dispersed within the elastic insulating material 152 in order to shield an external noise signal. The signal shielding unit 420 is adjacent to a plurality of the signal transmission units 410 between the plurality of signal transmission units 410 and is positioned in the middle of the insulation unit 430 so that the signal shielding unit 420 is spaced apart from the plurality of signal transmission units 410 with a gap interposed therebetween. The conductive particles 154 configuring the signal transmission unit 410 may be used as the conductive particles 154 configuring the signal shielding unit 420. Furthermore, the elastic insulating material 152 configuring the signal shielding unit 420 may be solidified in an integrated form along with the elastic insulating material 152 of the signal transmission unit 410.

The signal shielding unit 420 includes a block shielding unit 421, an internal high-density shielding unit 422 positioned within the block shielding unit 421, and an external high-density shielding unit 423 positioned to surround the block shielding unit 421. The density of conductive particles of the internal high-density shielding unit 422 and the external high-density shielding unit 423 is higher than the density of conductive particles of the block shielding unit 421. The internal high-density shielding unit 422 may be connected to an electronic device connected to the signal transmission unit 410 or may be connected to another electronic device having a ground part.

A shield unit protrusion 424 protruded from a surface of the block shielding unit 421 is provided at the end of the internal high-density shielding unit 422. The shield unit protrusion 424 can more stably come into contact with an electronic device because it is protruded from the block shielding unit 421. The signal shielding unit 420 can be stably grounded through the shield unit protrusion 424. Furthermore, the signal shielding unit 420 can be stably grounded because the internal high-density shielding unit 422 has relatively high density of conductive particles. Accordingly, shielding efficiency of a noise signal can be increased.

As described above, the signal shielding unit 420 has excellent noise signal shielding performance compared to a conventional technology because the signal shielding unit 420 has a structure in which the distribution area of the conductive particles 154 has been extended adjacent to the signal transmission unit 410 compared to the conventional signal shielding unit 30 shown in FIG. 1 or 2.

As described above, the signal transmission connector 400 may be fabricated in such a way as to inject a molding material into a molding die including a plurality of magnetic bodies and applying a proper magnetic field to the molding material.

Although preferred examples of the present invention have been described, the scope of the present invention is not limited to the aforementioned and shown forms.

For example, the shape, number or arrangement of the signal transmission unit 110 and the insulation unit 130 disposed within the signal shielding unit 120 of the signal transmission connector 100, such as those shown in FIGS. 3 and 4, may be changed in various manners. Furthermore, a shape of the signal shielding unit 120 is not limited to the illustrated shape, and may be changed in various manners.

Furthermore, although the ends on both sides of the signal transmission unit 110 have been illustrated as being protruded from both ends of the signal shielding unit 120, respectively, only one of both ends of the signal transmission unit may be protruded from the signal shielding unit or both ends of the signal transmission unit may be positioned at the same height as a surface of the signal shielding unit.

Furthermore, upon fabrication of the signal transmission connector 100, such as those shown in FIGS. 3 and 4, one first upper magnetic body 212 and one second upper magnetic body 214 have been illustrated as being used in order to fabricate the signal shielding unit 120 into the triple structure including the block shielding unit 121, the internal high-density shielding unit 122, and the external high-density shielding unit 123 having different densities of conductive particles. However, the number of first upper magnetic bodies 212 and second upper magnetic bodies 214 used to form the signal shielding unit 120 may be changed in various manners. For example, the first upper magnetic body and second upper magnetic body for forming the block shielding unit 121, the first upper magnetic body and second upper magnetic body for forming the internal high-density shielding unit 122, and the first upper magnetic body and second upper magnetic body for forming the external high-density shielding unit 123 may be separately provided.

For another example, magnetic fields having different intensities may be applied to the molding material 300 for the first upper magnetic body 212 and the second upper magnetic body 214 using a plurality of electromagnets capable of forming different magnetic fields in order to form the signal shielding unit 120 having the triple structure.

Furthermore, the shape, number or arrangement of the signal transmission unit 410 and the signal shielding unit 420 disposed within the insulation unit 430 of the signal transmission connector 400, such as those shown in FIGS. 9 and 10, may be changed in various manners.

Although the present invention has been shown and described in relation to the preferred embodiments for illustrating the principle of the present invention, the present invention is not limited to the aforementioned configurations and operations shown and described above. Those skilled in the art will appreciate that the present invention may be changed and modified in various ways without departing from the spirit and scope of the present invention.

The invention claimed is:

1. A signal transmission connector connected to an electronic device for transmitting an electrical signal, comprising:

a signal shielding unit in which multiple conductive particles are dispersed within an elastic insulating material in order to shield an external noise signal;

a plurality of signal transmission units spaced apart from each other within the signal shielding unit in a form in which the multiple conductive particles are arranged in a thickness direction within the elastic insulating materials so that the signal transmission units are connected to terminals of the electronic device; and a plurality of insulation units each disposed to surround the signal transmission unit between the signal transmission unit and the signal shielding unit in order to insulate the plurality of signal transmission units and the signal shielding unit, wherein the signal shielding unit surrounds the signal transmission unit by a triple shielding structure, the triple shielding structure comprising:

a block shielding unit in which the plurality of signal transmission units and the plurality of insulation units are disposed and in which the multiple conductive particles are dispersed within the elastic insulating material, the block shielding unit having lower density of the conductive particles than the signal transmission unit, a plurality of internal high-density shielding units each disposed to surround the insulation unit between the block shielding unit and the insulation unit, the internal high-density shielding unit having higher density of the conductive particles than the block shielding unit, and an external high-density shielding unit positioned to surround edges of the block shielding unit and having higher density of the conductive particles than the block shielding unit.

2. The signal transmission connector of claim 1, wherein the insulation unit is made of an insulating material, wherein the insulating material of the insulation unit is solidified in an integrated form along with an insulating material of the signal shielding unit and an insulating material of the signal transmission unit.

3. The signal transmission connector of claim 1, wherein ends on both sides of the signal transmission unit are protruded from surfaces on both sides of the signal shielding unit.

4. A signal transmission connector connected to an electronic device for transmitting an electrical signal, comprising:

a plurality of signal transmission units in which multiple conductive particles are arranged in a thickness direction within an elastic insulating material so that the signal transmission units are connected to terminals of the electronic device;

an insulation unit supporting to insulate the plurality of signal transmission units by surrounding surroundings of the plurality of signal transmission units; and a signal shielding unit configured in a form in which multiple conductive particles are dispersed within the elastic insulating material in order to shield an external noise signal, positioned adjacent to the plurality of signal transmission units between the plurality of signal transmission units, and positioned in a middle of the insulation unit so that the signal shielding unit is spaced apart from the plurality of signal transmission units with a gap between the signal shielding unit and each of the plurality of signal transmission units, wherein the signal shielding unit has a triple shielding structure, the triple shielding structure comprising:

a block shielding unit in which the multiple conductive particles are dispersed within the elastic insulating material, the block shielding unit having lower density of the conductive particles than the signal transmission unit, a plurality of internal high-density shielding units each positioned within the block shielding unit, the internal high-density shielding unit having higher density of the conductive particles than the block shielding unit, and an external high-density shielding unit positioned to surround edges of the block shielding unit, the external high-density shielding unit having higher density of the conductive particles than the block shielding unit.

5. The signal transmission connector of claim 4, wherein the insulation unit is made of an elastic insulating material, wherein the elastic insulating material of the insulation unit is solidified in an integrated form along with an elastic insulating material of the signal shielding unit and an elastic insulating material of the signal transmission unit.

6. The signal transmission connector of claim 4, wherein an end of the internal high-density shielding unit is protruded from a surface of the block shielding unit.

7. A method of fabricating a signal transmission connector, comprising:

(a) preparing an upper die, comprising an upper die plate, a first upper magnetic body positioned on an inside of the upper die plate and provided with a plurality of upper magnetic body holes, a plurality of second upper magnetic bodies disposed on the inside of the upper die plate in such a way as to be disposed within the plurality of upper magnetic body holes, respectively, and a plurality of upper non-magnetic bodies disposed on the inside of the upper die plate in such a way as to surround a circumference of the second upper magnetic body between the plurality of first upper magnetic bodies and the second upper magnetic body; and a lower die, comprising a lower die plate, a first lower magnetic body positioned on an inside of the lower die plate and provided with a plurality of lower magnetic body holes in a middle of the first lower magnetic body, a plurality of second lower magnetic bodies disposed on the inside of the lower die plate in such a way as to be disposed within the plurality of lower magnetic body holes, respectively, and a plurality of lower non-magnetic bodies disposed on the inside of the upper die plate in such a way as to surround a circumference of the second lower magnetic body between the first lower magnetic body and the second lower magnetic body;

(b) injecting a molding material, containing conductive particles within a liquefied elastic insulating material, into a cavity provided between the upper die and the lower die;

(c) forming a plurality of signal transmission units by vertically applying a magnetic field to the molding material injected into the cavity through the plurality of second upper magnetic bodies and the plurality of second lower magnetic bodies so that some of the conductive particles of the molding material are concentrated between the second upper magnetic body and the second lower magnetic body, forming a signal shielding unit to surround surroundings of the plurality of signal transmission units by vertically applying a magnetic field to the molding material injected into the cavity through the plurality of first upper magnetic bodies and the first lower magnetic body so that some of the conductive particles of the molding material are dispersed into the surroundings of the plurality of signal transmission units, and concentrating the conductive particles of the molding material on the signal transmission unit and the signal shielding unit so that an electrical connection by the conductive particles of the molding material is not formed between the signal transmission unit and the signal shielding unit, thus forming a plurality of insulation units;

(d) forming a signal transmission connector by solidifying the molding material; and (e) separating the signal transmission connector from the upper die and the lower die, wherein in the step (c), the signal shielding unit is configured in a form to surround the signal transmission unit by a triple shielding structure, comprising:

a block shielding unit in which the plurality of signal transmission units and the plurality of insulation units are disposed and the multiple conductive particles are dispersed within the elastic insulating material, the block shielding unit having lower density of the conductive particles than the signal transmission unit, a plurality of internal high-density shielding units each disposed to surround the insulation unit between the block shielding unit and the insulation unit, the internal high-density shielding unit having higher density of the conductive particles than the block shielding unit, and an external high-density shielding unit positioned to surround edges of the block shielding unit and having higher density of the conductive particles than the block shielding unit, by inducting a strong magnetic field compared to other portions of the plurality of first upper magnetic bodies into a circumference and external edge portion of the upper magnetic body hole among the plurality of first upper magnetic bodies, and inducing a strong magnetic field compared to other portions of the first lower magnetic body into a circumference and external edge portion of the lower magnetic body hole among the first lower magnetic body.

8. The signal transmission connector of claim 2, wherein the electric insulating material is elastic.

9. The signal transmission connector of claim 3, wherein the electric insulating material is comprised of a thermostable polymer material.

10. The signal transmission connector of claim 9, wherein the electric insulating material is one or more of silicon rubber, polybutadiene rubber, natural rubber, polyisoprene rubber, styrene-butadiene copolymer rubber, acrylonitrile-butadiene copolymer rubber, styrene-butadiene-dien block copolymer rubber, styrene-isoprene block copolymer rubber, urethane rubber, polyester rubber, epicrolhydrin rubber, ethylene-propylene copolymer rubber, ethylene-propylene-dien copolymer rubber, or soft liquefied epoxy rubber.

11. The signal transmission connector of claim 1, wherein the internal high-density shielding units and external high-density shielding unit are grounded to the electronic device.

12. The signal transmission connector of claim 1, wherein the signal transmission units have a cylindrical shape, the insulation units have a cylindrical shape, and the external high-density shielding unit has a rectangular shape.

13. The signal transmission connector of claim 1, further comprising:

a support plate for supporting the signal shielding unit.

14. The signal transmission connector of claim 4, wherein the electric insulating material is elastic.

15. The signal transmission connector of claim 14, wherein the electric insulating material is comprised of a thermostable polymer material.

16. The signal transmission connector of claim 15, wherein the electric insulating material is one or more of silicon rubber, polybutadiene rubber, natural rubber, polyisoprene rubber, styrene-butadiene copolymer rubber, acrylonitrile-butadiene copolymer rubber, styrene-butadiene-dien block copolymer rubber, styrene-isoprene block copolymer rubber, urethane rubber, polyester rubber, epicrolhydrin rubber, ethylene-propylene copolymer rubber, ethylene-propylene-dien copolymer rubber, or soft liquefied epoxy rubber.

17. The signal transmission connector of claim 4, wherein the internal high-density shielding units and external high-density shielding unit are grounded to the electronic device.

18. The signal transmission connector of claim 4, wherein the signal transmission units have a cylindrical shape, the insulation units have a cylindrical shape, and the external high-density shielding unit has a rectangular shape.

19. The signal transmission connector of claim 4, further comprising:

a support plate for supporting the signal shielding unit.

20. The method of fabricating a signal transmission connector of claim 7, wherein step (a) further comprises:

placing a spacer and a support plate between the upper die and the lower die.

* * * * *